United States Patent [19]

Latz et al.

[11] Patent Number: 4,603,496

[45] Date of Patent: Aug. 5, 1986

[54] ELECTRONIC DISPLAY WITH LENS MATRIX

[75] Inventors: William J. Latz, New Berlin; Thomas J. Mandler, Grafton, both of Wis.; Jason C. S. Lai, Taipei, Taiwan

[73] Assignee: Adaptive Micro Systems, Inc., Butler, Wis.

[21] Appl. No.: 698,021

[22] Filed: Feb. 4, 1985

[51] Int. Cl.[4] ..... G09F 13/00

[52] U.S. Cl. ..... 40/547; 40/452; 313/500; 313/510; 313/512

[58] Field of Search ..... 40/452, 550, 547, 546; 313/512, 500, 499, 510

[56] References Cited

U.S. PATENT DOCUMENTS

| | | | |
|---|---|---|---|
| 3,760,237 | 9/1973 | Jaffe | 313/512 |
| 3,805,347 | 4/1974 | Collins et al. | 313/512 |
| 3,821,775 | 6/1974 | Biard | 313/512 |
| 4,000,437 | 12/1976 | Lederhandler et al. | 313/512 |
| 4,113,347 | 9/1978 | Gaertner | 40/547 |
| 4,168,102 | 9/1979 | Chida et al. | 313/512 |
| 4,241,277 | 12/1980 | Hintze et al. | 313/512 |

FOREIGN PATENT DOCUMENTS

| | | | |
|---|---|---|---|
| 1166442 | 10/1969 | United Kingdom | 40/546 |
| 2069215 | 8/1981 | United Kingdom | 40/547 |

*Primary Examiner*—Gene Mancene
*Assistant Examiner*—Cary E. Stone
*Attorney, Agent, or Firm*—Barry E. Sammons

[57] ABSTRACT

An electronic display includes a matrix of LEDs mounted to a circuit board and selectively operated to produce a message or image. A reflector matrix mounts to the circuit board and provides light pipes which extend forward from each LED to direct its light and provide protection. A lens matrix is mounted to the reflector matrix and it provides convex lenses which are aligned to be received in the light pipes.

3 Claims, 3 Drawing Figures

ELECTRONIC DISPLAY WITH LENS MATRIX

BACKGROUND OF THE INVENTION

The field of the invention is electronic displays, and particularly, displays which employ a matrix of illuminating devices that are individually operated to produce illuminated alpha-numeric characters and graphic symbols.

Electronic displays which employ a matrix of illuminating devices are well-known in the art. Such displays may include a plurality of light emitting diodes (LEDs) which are mounted on a printed circuit board in an array. By selectively energizing the LEDs with electronic circuitry also on the circuit board, a variety of illuminated characters and symbols can be produced. To reduce cost and improve appearance, it is also common to attach the LED chips, or dies, directly to the printed circuit board and provide a shaped reflector over the LED dies. To protect the LED dies, the reflector is either covered with a transparent sheet material, or a transparent potting compound is poured over the dies. In either case, the front surface of these prior display arrays is flat.

While electronic displays of this type are quite satisfactory for many applications, their use in retail stores has been limited. In such an environment the ambient light is very intense and the light emitted by electronic displays is not sufficient to be clearly seen or to draw attention to itself.

SUMMARY OF THE INVENTION

The present invention relates to an electronic display which includes a matrix of electronic illuminating devices mounted to a circuit board, a reflector matrix which provides a matrix of light pipes that align with the matrix of electronic illuminating devices and direct the light produced by the electronic illuminating devices away from the circuit board, and a lens matrix which is disposed over the reflector to provide a matrix of convex lenses that align with the matrix of light pipes to redirect light which emanates therefrom. The electronic display further includes a potting compound which is disposed in each light pipe and which substantially fills the space between the electronic illuminating device and the convex lens.

A general object of the invention is to provide an electronic display which provides greater illumination. Nearly all of the light produced by the electronic illuminating device is directed through its associated light pipe and out through the convex lens. Very little light is reflected back at the boundaries of the elements in the light path.

Another object of the invention is to provide an electronic display which is easy and economical to manufacture. The reflector matrix may be molded as a single piece which is bonded to the circuit board and a single-piece, molded lens matrix. The potting compound serves to improve the transmission of light through each light pipe and to bond the elements together.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
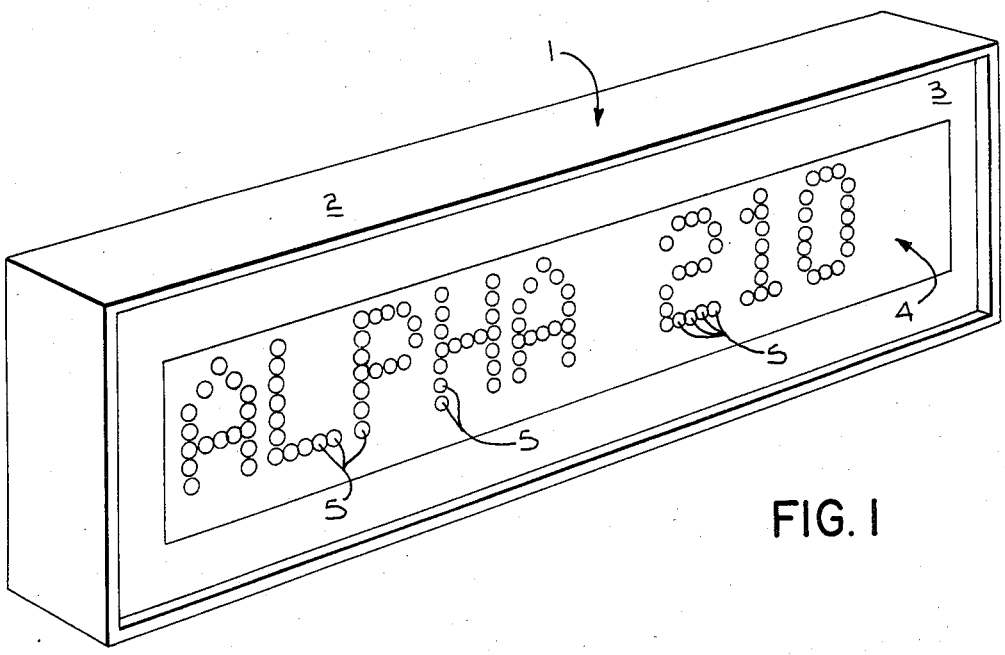
FIG. 1 is a perspective view of an electronic display which employs the present invention.

Referring particularly to FIG. 1, an electronic display 1 is housed in an enclosure 2 having a rectangular opening in its front wall 3 through which a display matrix 4 is directed. As will be described in more detail below, the display matrix 4 includes a plurality of illuminating devices 5 which are arranged side-by-side in columns and rows. An electronic circuit (not shown in the drawings) is mounted within the enclosure 2, and it is programmed to separately operate each illuminating device 5 such that a message or image is collectively produced in the rectangular opening.

The preferred illuminating device 5 for this application is a light emitting diode (LED). A LED may be driven directly by TTL logic circuitry making it a relatively inexpensive device to operate, and it does not contain a filament making it a relatively reliable device. However, LEDs produce a limited amount of light, and when the electronic display 1 is employed in locations where the ambient light level is high, this light must be efficiently delivered to the viewer if the message or image is to be clearly seen.

Figure 2:
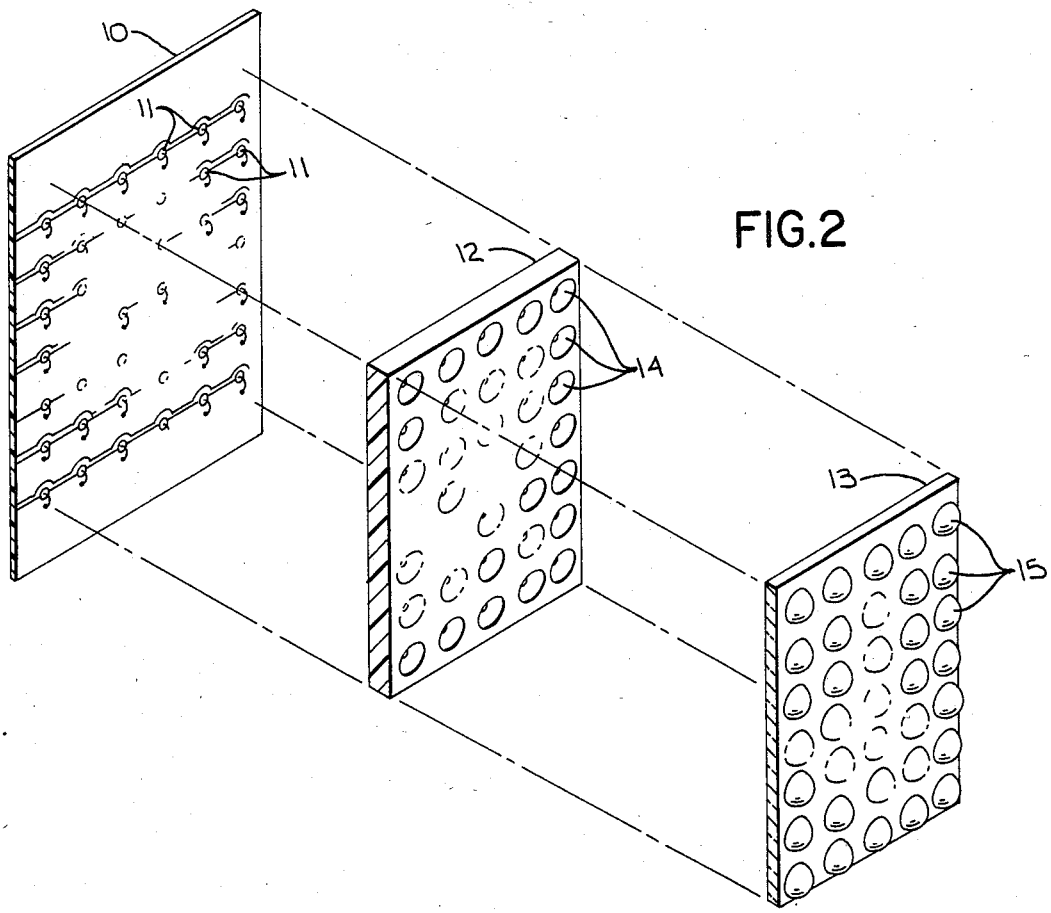
FIG. 2 is an exploded partial perspective view of a display matrix which forms part of the electronic display of FIG. 1.
Figure 3:
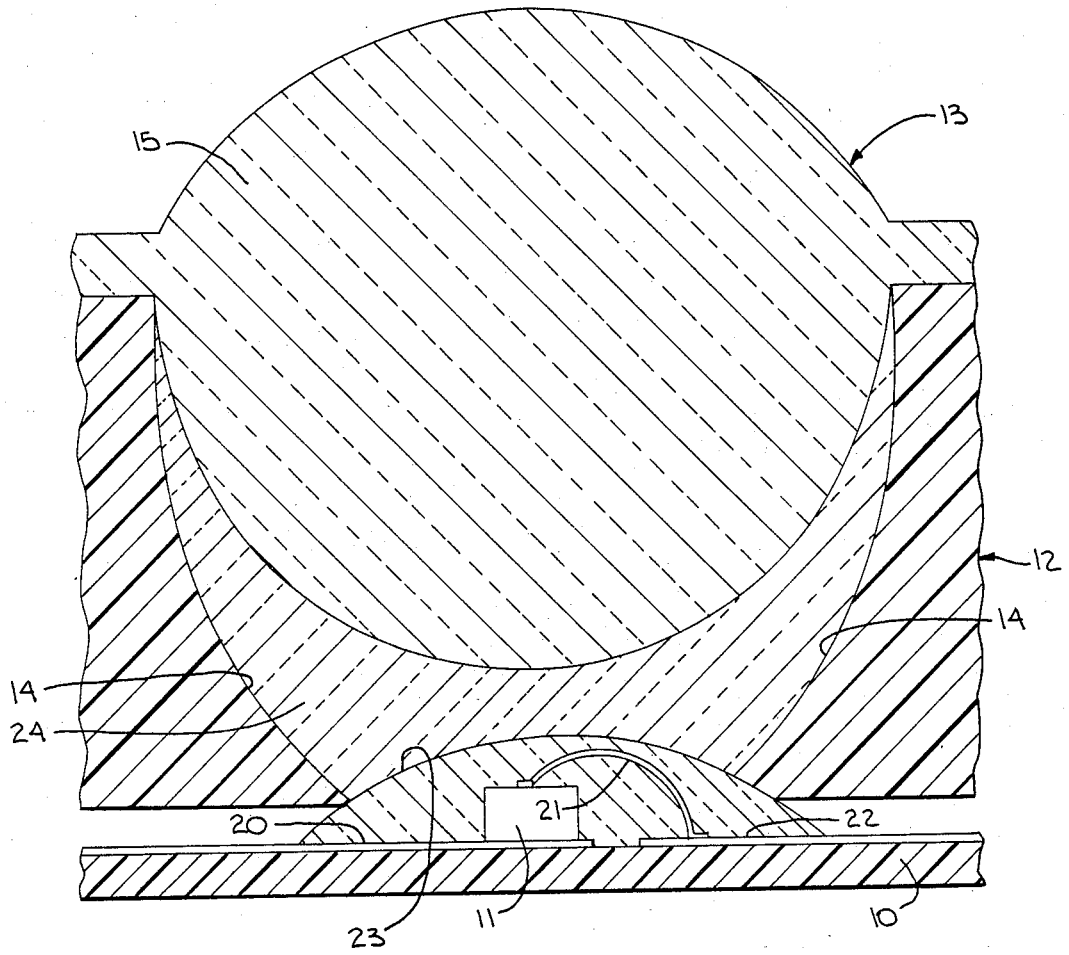
FIG. 3 is a view in cross section taken through one of the illuminating devices in the display matrix of FIG. 2.

Referring particularly to FIGS. 2 and 3, the display matrix of the present invention is a low cost, durable and efficient means for electronically displaying a message or image. It includes three basic elements: a printed circuit board 10 which supports a matrix of LED dies 11; a reflector matrix 12; and a lens matrix 13. The LED dies 11 are arranged in rows and columns on the printed circuit board 10, and the reflector matrix 12 is placed over the LED dies 11 and bonded to the printed circuit board 10. Contoured openings extend through the reflector matrix 12 and are aligned with the matrix of LED dies 11 to form light pipes 14. The reflector matrix 12 is molded from a white ABS polymer material and each light pipe 14 forms a polished reflector which directs the light produced by its associated LED die 11 out to a viewer. The lens matrix 13 is molded from a clear acrylic polymer material and it includes separate convex lens elements 15 which are aligned with the matrix of light pipes 14. The lens matrix 1 is bonded to the front of the reflector matrix 12 and the domed back surface of each lens element 15 is received in its associated light pipe 14.

The resulting structure is shown in detail in FIG. 3. The LED die 11 is attached to a gold plated conductive pad 20 on the front surface of the printed circuit board 10 with a silver epoxy. After curing the silver epoxy a bond wire 21 is ultrasonically bonded to the LED die 11 at one end and bonded to a second conductive pad 22 at the other end. The LED die 11 is then coated with a layer 23 of a urethane polymer such as "Hysol PC-18," which protects the LED die 11 and bond wire 21 during the remaining manufacturing process.

The reflector matrix 12 is then placed over the circuit board 10 and the light pipe cavities 14 are filled with a potting compound 24. Silicon rubber 24, such as that sold under the trade name "RTV," and containing a small amount of diffusant material such as "Hysol AC 7088 Resin" in a silicon base, is preferred. It is degassed to prevent the formation of air bubbles in the light pipe 14, and the lens matrix 13 is then placed over the reflector matrix 12 and the assembly is cured.

Referring still to FIG. 3, the resulting structure insures that light which is produced by the LED die 11 when electrical power is applied to the conductive pads 20 and 22 is efficiently delivered to an observer. The urethane layer 23, potting compound 24 and lens 15 all have an index of refraction which is substantially greater than that of air. Indeed, the indexes of refraction of these materials and the material through which light passes from the LED die 11 are substantially the same. As a result, the critical angles at which light is totally reflected at the boundaries of these materials is large and very little light is reflected back and lost to the viewer. While the critical angle at the boundary between the front surface of the lens 15 and air is small, its convex shape and distance from the LED die 11 insures that most of the incident light is received at a small incident angle and is passed through to the viewer.

It should be apparent to those skilled in the art that a number of variations may be made from the preferred embodiment without departing from the spirit of the invention. For example, the arrangement and shape of the light pipes 14 and the matching lens matrix 13 may be changed to produce other visual effects. The light pipes may be rectangular and the resulting image may be a familiar seven-segment display rather than the dot matrix display described herein. In such case, each lens 15 has a cylindrical shape over its lengthwise dimension rather than the domed, spherical shape of the preferred embodiment.

Also, the convex lens elements 15 in the preferred embodiment have a convex back surface which extends into the light pipe 14. This preferred design reduces the amount of the more costly silicon rubber material 24 that is required to fill the light pipe cavity 14. If the index of refraction of the silicon rubber material 24 is nearly the same as the index of refraction of the lens element 15, then the back surface of the lens element 15 can have other shapes without unduly reducing the amount of light.

We claim:

1. An electronic display which comprises:

a printed circuit board having a plurality of light emitting devices mounted to its front surface and arranged in a pattern;

a reflector matrix disposed over the front surface of the printed circuit board and having a plurality of openings formed therethrough which are aligned with the light emitting devices in said pattern to provide a light pipe which extends forward from each light emitting device, each said light pipe being concave opening away from the light emitting device with a smaller open end adjacent to the printed circuit board and a larger open end opposite from the printed circuit board;

a lens matrix disposed over the front surface of the reflector matrix and having a plurality of lenses which are aligned with the light pipes in said pattern to provide a lens over the forward end of each light pipe, each said lens having front and rear convex surfaces, said rear convex surface extending into the corresponding light pipe and filling the larger opening of the light pipe;

a potting compound filling each light pipe between the printed circuit board and the lens matrix; and wherein the side surfaces of said potting compound contact and are defined by the light pipe and the front surface of the potting compound contacts and is defined by the lens.

2. An electronic disply as in claim 1, further comprising a transparent protective material covering each light emitting device and wherein the rear surface of the potting compound is in contact with and defined by the protective material.

3. An electronic display as in claim 2, wherein the potting compound contains a light diffusing material.

* * * * *